US012571272B2

(12) United States Patent
Eitschberger

(10) Patent No.: US 12,571,272 B2
(45) Date of Patent: Mar. 10, 2026

(54) SETTING TOOL FOR ACTUATING A TOOL IN A WELLBORE

(71) Applicant: DynaEnergetics Europe GmbH, Troisdorf (DE)

(72) Inventor: Christian Eitschberger, Munich (DE)

(73) Assignee: DynaEnergeics Europe GmbH, Troisdorf (DE)

( * ) Notice: Subject to any disclaimer, the term of this patent is extended or adjusted under 35 U.S.C. 154(b) by 0 days.

(21) Appl. No.: 18/390,416

(22) Filed: Dec. 20, 2023

(65) Prior Publication Data

US 2024/0200415 A1 Jun. 20, 2024

Related U.S. Application Data

(60) Provisional application No. 63/578,271, filed on Aug. 23, 2023, provisional application No. 63/492,298, filed on Mar. 27, 2023, provisional application No. 63/476,289, filed on Dec. 20, 2022.

(51) Int. Cl.
*E21B 23/04* (2006.01)

(52) U.S. Cl.
CPC ..... *E21B 23/04* (2013.01)

(58) Field of Classification Search
CPC .... E21B 23/065; E21B 23/0414; E21B 23/06; E21B 23/04; E21B 23/042; E21B 33/134; E21B 33/12; E21B 43/1185
See application file for complete search history.

(56) References Cited

U.S. PATENT DOCUMENTS

| | | | | |
|---|---|---|---|---|
| 3,298,437 | A * | 1/1967 | Conrad | E21B 33/1293 166/123 |
| 9,810,035 | B1 | 11/2017 | Carr et al. | |
| 9,995,115 | B2 | 6/2018 | Kasperski | |
| 10,519,733 | B2 | 12/2019 | Rosenthal et al. | |
| 10,934,794 | B2 | 3/2021 | Knight et al. | |
| 10,934,795 | B2 | 3/2021 | Wells | |
| 11,280,143 | B2 | 3/2022 | Robicheaux et al. | |
| 2017/0030693 | A1 | 2/2017 | Preiss et al. | |
| 2017/0051586 | A1 | 2/2017 | Wells et al. | |
| 2018/0080298 | A1 | 3/2018 | Covalt et al. | |
| 2018/0163497 | A1 | 6/2018 | Younger et al. | |
| 2019/0368293 | A1 | 12/2019 | Covalt et al. | |
| 2020/0115978 | A1 | 4/2020 | Mickey et al. | |

(Continued)

OTHER PUBLICATIONS

United States Patent and Trademark Office; Non-Final Office Action issued for U.S. Appl. No. 18/166,849; dated Mar. 28, 2024; 10 pages.

(Continued)

*Primary Examiner* — Tara Schimpf
*Assistant Examiner* — Lamia Quaim
(74) *Attorney, Agent, or Firm* — Womble Bond Dickinson (US) LLP

(57) ABSTRACT

A disposable setting tool may include an outer housing and a piston. The outer housing may have a proximal end portion defining a power charge chamber and a distal end portion. The outer housing may define a longitudinally-extending bore configured for holding a medium therein. The bore and the power charge chamber may be divided from one another by a proximal wall. The piston may be configured for receipt in the bore and to move axially relative to the outer housing.

17 Claims, 12 Drawing Sheets

(56) References Cited

U.S. PATENT DOCUMENTS

| | | | | |
|---|---|---|---|---|
| 2021/0040805 | A1 | 2/2021 | Kehoe et al. | |
| 2021/0108475 | A1 | 4/2021 | Covalt et al. | |
| 2021/0164308 | A1 | 6/2021 | Robertson et al. | |
| 2021/0215010 | A1 | 7/2021 | Tonti | |
| 2021/0340829 | A1 | 11/2021 | Watkins et al. | |
| 2021/0355773 | A1* | 11/2021 | Eitschberger ..... | E21B 41/0085 |

OTHER PUBLICATIONS

United States Patent and Trademark Office; Final Office Action issued for U.S. Appl. No. 18/166,849; dated Aug. 16, 2024; 12 pages.

United States Patent and Trademark Office; Notice of Allowance issued for U.S. Appl. No. 18/166,849; dated Nov. 1, 2024; 9 pages.

Wellboss; Disposable Setting Tools; downloaded Jun. 6, 2024; 2 pages; https://thewellboss.com/2022/08/11/disposable-setting-tools/.

* cited by examiner

SETTING TOOL FOR ACTUATING A TOOL IN A WELLBORE

CROSS-REFERENCE TO RELATED APPLICATIONS

This application claims the benefit of U.S. Provisional Patent Application No. 63/578,271 filed Aug. 23, 2023. This application claims the benefit of U.S. Provisional Patent Application No. 63/492,298 filed Mar. 27, 2023. This application claims the benefit of U.S. Provisional Patent Application No. 63/476,289 filed Dec. 20, 2022. The entire contents of each application listed above are incorporated herein by reference.

BACKGROUND OF THE DISCLOSURE

Oil and gas are extracted by subterranean drilling and introduction of machines into the resultant wellbore. It is often advantageous or required that portions of a wellbore be sealed off from other portions of the wellbore. Among other functions, a running or setting tool is utilized to place plugs at locations inside the wellbore to seal portions thereof from other portions.

Primarily used during completion or well intervention, a plug isolates a part of the wellbore from another part. For example, when work is carried out on an upper section of the well, the lower part of the wellbore must be isolated and plugged; this is referred to as zonal isolation. Plugs can be temporary or permanent. Temporary plugs can be retrieved whereas permanent or frac plugs can only be removed by destroying them with a drill. There are a number of types of plugs, e.g., bridge plugs, cement plugs, frac plugs and disappearing plugs. Plugs may be set using a setting tool conveyed on, for example, a wire-line, coiled tubing or a drill pipe.

In a typical operation, a plug can be lowered into a well and positioned at a desired location in the wellbore. A setting tool may be attached to and lowered along with the plug or it may be lowered after the plug, into an operative association therewith. The setting tool may include a power charge and a piston; activation of the power charge results in a substantial force by means of combustion being exerted on the setting tool piston. When it is desired to set the plug, the power charge is initiated, resulting in the power charge burning, pressure being generated and the piston being subjected to a substantial force. The piston being constrained to movement in a single direction, the substantial force causes the piston to move axially and actuate the plug to seal a desired area of the well. The substantial force exerted by the power charge on the piston can also shear one or more shear pins or similar frangible members that serve certain functions, e.g., holding the piston in place prior to activation and separating the setting tool from the plug.

The force applied to a plug by the power charge and/or setting tool piston must be controlled; it must be sufficient to set the plug or to similarly actuate other tools but excessive force may damage the setting tool, other downhole tools or the wellbore itself. Also, even a very strong explosive force can fail to actuate a tool if delivered over a too short time duration. Even if a strong force over a short time duration will actuate a tool, such a set-up is not ideal. That is, a power charge configured to provide force over a period of a few seconds instead of a few milliseconds is sometimes preferred; such an actuation is referred to as a "slow set".

Favorable setting characteristics may be provided with either a fast set or a slow set, depending on the tool being set and other parameters.

Plug setting tools and other components in the tool string such as perforating gun assemblies in particular are also subject to tremendous shock when the plug is detached from the setting tool even in slow set devices. For example, combustion of the power charge may generate gas pressure to urge the piston against a setting sleeve that is locked, e.g., by shear pins, in a first position above the plug. The shear pins shear under a threshold amount of force and the piston forces the setting sleeve to a second position. The plug is set and detached from the setting tool by the time the setting sleeve reaches the second position. The sudden detachment and setting of the plug under the force of the piston may impart to the piston a drastic accelerative force (i.e., a "kick") in the opposite direction. The degree of the kick may vary among combinations of known plugs and setting tools from different manufacturers. Some kicks are strong enough to damage the setting sleeve, setting tool, and upstream components. The piston may also accelerate as it continues its travel, or stroke, until it is mechanically stopped by a barrier or connection to another component of the setting tool. The sudden mechanical stop may create additional damaging forces or deform components.

Existing setting tools and techniques involve multiple components, many of which need to have precise tolerances. Thus, current setting tools are complex, heavy, expensive and of substantial axial length. The complexity and important functions served by setting tools has resulted in the need, primarily driven by economic and efficiency considerations, of a reusable setting tool. That is, the substantial number of expensive components and importance of 'knowing,' from an engineering perspective, exactly how a setting tool is going to operate under a particular set of circumstances, resulted in the need to reuse a setting tool a number of times. Thus, a typical setting tool is retrieved from the wellbore after use and 'reset' prior to its next run down the wellbore. Resetting a setting tool involves fairly laborious steps performed by a skilled operator to prepare, i.e., clean the used tool, replace the consumable parts and otherwise place the setting tool in 'usable' condition. Consumable parts in a setting tool may include the power charge, power charge initiating/boosting elements, elastomers, oil, burst discs and/or shear elements/screws. The combustible/explosive nature of the power charge as well as the initiating/booster elements present another set of issues regarding the need for a skilled operator/resetting.

Further, the power charge may include an initiating or booster element (collectively, "booster element") connected to the power charge, at a particular position on the power charge. The setting tool (or other wellbore tool) may include a detonator or other initiator for initiating the booster element. The booster element may enhance ignition of the power charge compared to the detonator or initiator alone. For example, the booster element may be capable of greater energy release than the detonator or initiator and may be in contact with a surface area of the power charge. The orientation of the power charge within the wellbore tool places the booster element in sufficient proximity to the detonator or initiator. However, many power charges are symmetrically shaped, and a user may erroneously position a power charge "backwards"—i.e., with the booster element positioned away from the detonator or initiator—within the wellbore tool.

In view of the disadvantages associated with currently available wellbore tools such as setting tools and power charges for use therein, there is a need in the wellbore industry for a safe, predictable, and economical setting tool that reduces the possibility of human error during assembly.

BRIEF DESCRIPTION OF THE EXEMPLARY EMBODIMENTS

In an aspect, this disclosure is directed to a disposable setting tool for actuating a tool in a wellbore. The disposable setting tool may include an outer housing having a proximal end portion defining a power charge chamber and a distal end portion, and a piston. The outer housing may define a longitudinally-extending bore configured for holding a medium therein. The bore and the power charge chamber may be divided from one another by a proximal wall. The piston may be configured for receipt in the bore and to move axially relative to the outer housing.

In another aspect, this disclosure is directed to a tool for setting a plug in a wellbore. The tool for setting a plug in a wellbore may include an outer housing and a piston. The outer housing may have a proximal end portion defining a power charge chamber, a distal end portion configured for coupling to a setting sleeve, and an intermediate portion extending between the proximal end portion and the distal end portion. The intermediate portion may have an annular inner surface defining a longitudinally-extending central bore configured for holding a dampening medium therein. A power charge may be received in the power charge chamber. The piston may be received in the central bore and configured to translate relative to the annular inner surface, and the outer housing may define a longitudinally-extending gas channel in fluid communication with the power charge chamber and the piston such that the piston is configured to move proximally within the central bore in response to a combustion of the power charge.

In another aspect, this disclosure is directed to a tool for setting a plug in a wellbore. The tool may include an outer housing and a piston. The outer housing may include a proximal end portion defining a power charge chamber, and a distal end portion configured for coupling to a setting sleeve. A power charge may be positioned in the power charge chamber and a dampening medium may be stored in the outer housing and positioned distally of the power charge. The piston may be received in the outer housing and hydraulically coupled to the dampening medium, The outer housing may define a longitudinally-extending gas channel having a proximal end portion in fluid communication with the power charge chamber, and a distal end portion positioned adjacent the piston, such that the piston is configured to move proximally within the outer housing in response to a combustion of the power charge.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
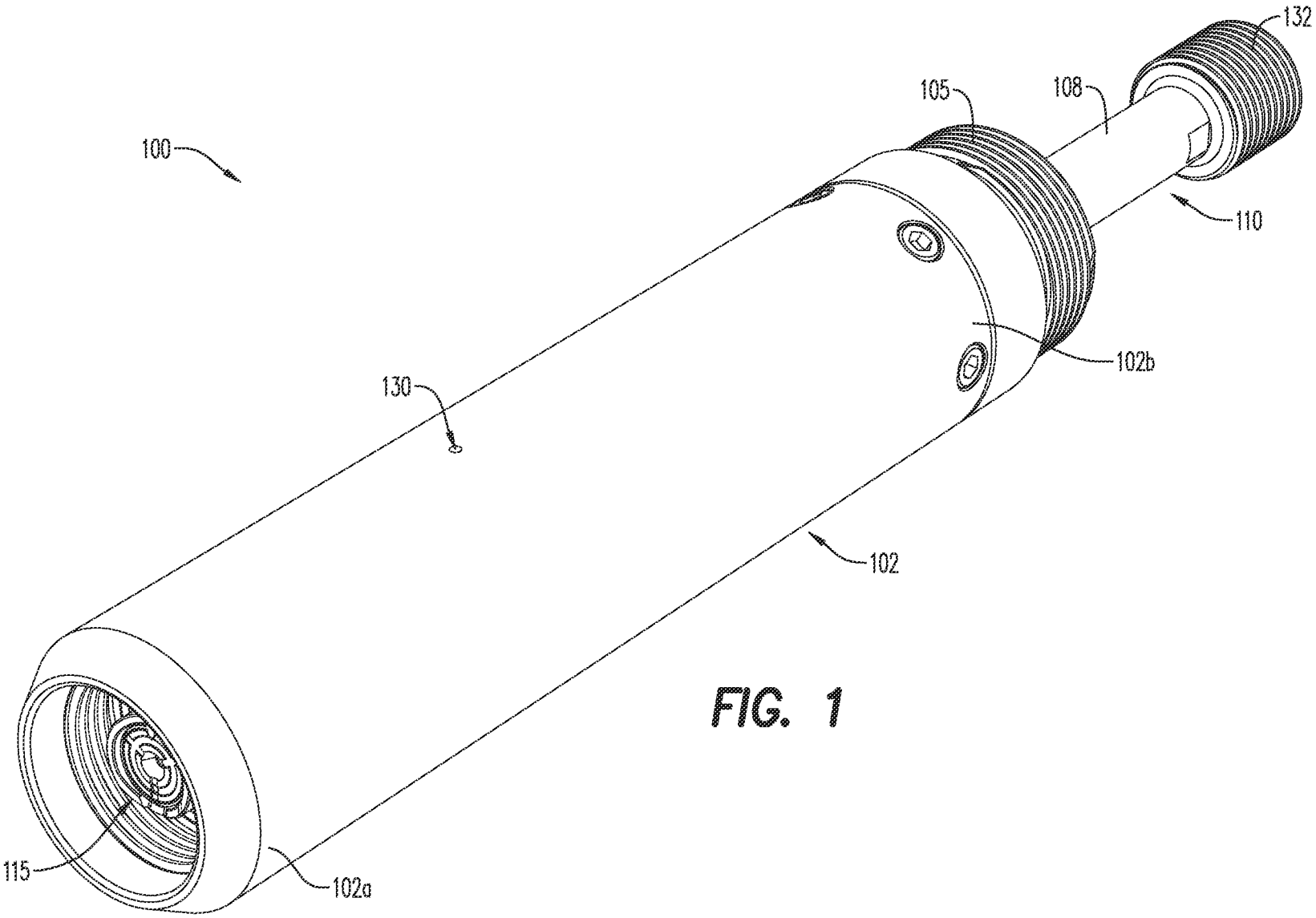
FIG. 1 is a perspective view of a setting tool for actuating a tool in a wellbore, according to an exemplary embodiment.
Figure 2:
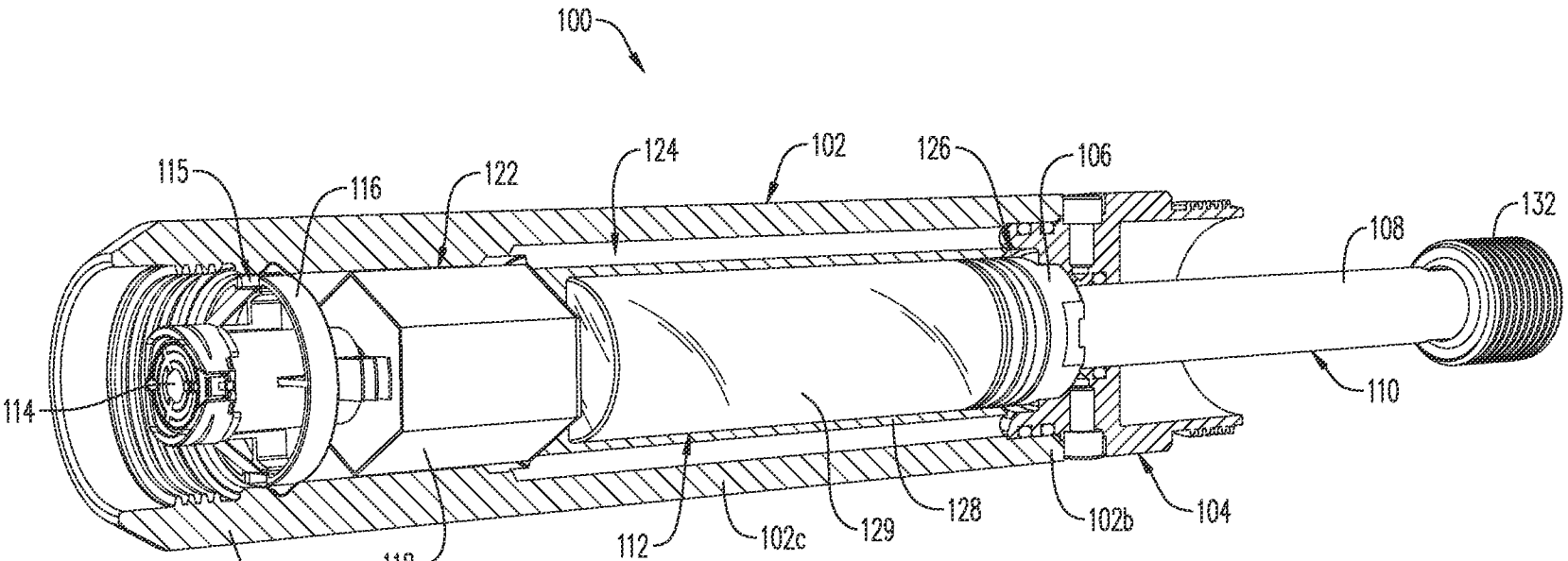
FIG. 2 is a perspective, cutaway view of the setting tool of FIG. 1.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

In the description that follows, the terms "setting tool," "mandrel," "initiator," "power charge," "piston," "bore," "grooves," "apertures," "channels," and/or other like terms are to be interpreted and defined generically to mean any and all of such elements without limitation of industry usage. Such terms used with respect to embodiments in the drawings should not be understood to necessarily connote a particular orientation of components during use.

In the drawings and in the description that follows, the term "proximal" will refer to the portion of the setting tool, or component thereof, that is positioned closer uphole to the ground surface when in use, while the term "distal" will refer to the portion of the setting tool, or component thereof, that is farther downhole from the ground surface when in use.

For purposes of illustrating features of the exemplary embodiments, examples will now be introduced and referenced throughout the disclosure. Those skilled in the art will recognize that these examples are illustrative and not limiting and is provided purely for explanatory purposes. In the illustrative examples and as seen in FIG. 1, single use setting tools for actuating a tool in a wellbore are disclosed. The setting tools may not require a separate firing head or power charge, rather an ignition system and power charge may be a part of the setting tools. A bulkhead seal and an electrical connector are connected within a proximal end of the setting tools for setting off the power charge. Further to the structure and usage of the initiator, U.S. Pat. No. 9,581,422, commonly owned by DynaEnergetics Europe GmbH, is incorporated herein by reference in its entirety to the extent it is not incompatible with the disclosure herein. Although U.S. Pat. No. 9,581,422 describes a "detonator," this component is more accurately referred to as an initiator or igniter when used with a power charge because the power charge herein does not explode; rather, the power charge deflagrates, i.e., is consumed by combustion.

With reference to FIGS. 1-4B, an exemplary embodiment of a setting tool 100 is provided for setting frac or bridge plugs in a tubular member of a wellbore. The setting tool 100 generally includes a setting tool outer body or outer housing 102, a piston sub 104 coupled to a distal end portion 102*b* of the outer housing 102, and a piston assembly 110 positioned within a longitudinally-extending central bore 112 defined through the outer housing 102. In aspects, the setting tool 100 may be a single use, disposable setting tool 100.

The outer housing 102 includes a proximal end portion 102*a*, the distal end portion 102*b*, and an intermediate portion 102*c* positioned between the proximal end portion 102*a* and the distal end portion 102*b*. The outer housing 102 may have a generally cylindrical shape and defines a power charge chamber 122 in the proximal end portion 102*a* thereof, and a central bore 112 through the intermediate portion 102*c* and the distal end portion 102*b*. The outer housing 102 includes an annular inner wall or surface 128 and a proximal wall or surface 120, which may extend approximately perpendicularly relative to a longitudinal axis of the outer housing 102. The central bore 112 is collectively defined by the annular inner wall 128 and the proximal wall 120. The proximal wall 120 divides and fluidly isolates the central bore 112 and the power charge chamber 122, such that the proximal wall 120 prevents the combustion gas within the power charge chamber 122 from mixing with a dampening medium 129 within the central bore 112. In another aspect, a separate cylindrical body may be provided in the outer housing 102 that defines the central bore 112.

The setting tool 100 further includes an ignition assembly 115 and a power charge 118 positioned within a power charge chamber 122 defined in the proximal end portion 102*a* of the outer housing 102. The power charge chamber 122 is separated from the central bore 122 by the proximal wall 120. The ignition assembly 115 includes an igniter 114 positioned within a holder 116. The power charge 118 is positioned between the igniter holder 116 and the proximal wall 120 and has a length defined along a longitudinal axis of the setting tool 100 that is less than about 6 inches. In aspects, the length of the power charge 118 may be less than about 4 inches. In aspects, the length of the power charge 118 may be from about 2 inches to about 4 inches, and in some aspects about 2.65 inches. The power charge 118 (including the cartridge and the pellet thereof) is specially designed to fit within the setting tool 100. Unexpectedly, reducing the length of the power charge 118 from standard-length power charges did not reduce the amount of gas pressure generated by the power charge 118. This is because the total mass of energetic material is effectively unchanged and the burn-rate propagation through the power charge 118 is improved as the power charge 118 has a larger surface area for the burn process.

The outer housing 102 defines a pair of longitudinally-extending gas channels 124 positioned on diametrically opposed sides of the central bore 112. The gas channels 124 may extend axially between the power charge chamber 122 and the piston sub 104. In another aspect, the setting tool 100 may include a single gas channel defined circumferentially about the entire annular inner wall 128 of the outer housing 102. The gas channels 124 include a proximal end portion 124*a* and a distal end portion 124*b*. The proximal end portion 124*a* of the gas channels 124 extend through or around the proximal wall 120 and are in fluid communication with the power charge chamber 122. The distal end portion 124*b* of the gas channels 124 are positioned adjacent the piston sub 104, and a piston 106 of the piston assembly 110 when the piston 106 is in the unactuated position.

For example, an expansion chamber 126 may be defined between the piston 106 and the piston sub 104 and may be in fluid communication with the distal end portion 124*b* of the gas channels 124. The expansion chamber 126 may be hydraulically connected to the power charge chamber 122 by the gas channels 124. The expansion chamber 126 may be hydraulically connected to a distal surface of the piston 106. In this way, as the power charge 118 combusts, the combustion gas travels distally from the power charge chamber 122, through the gas channels 124, and into the expansion chamber 126, whereby the piston 106 is driven proximally through the central bore 112 (e.g., when a pressure generated by the combustion exceeds a pre-set threshold). As the piston 106 is driven proximally, the expansion chamber 126 expands in length by the longitudinal distance travelled by the piston 106 (and similarly, a portion of the central bore 112 between the piston 106 and the proximal wall 120 may be reduced in length).

The central bore 112 of the outer housing 102 has a closed proximal end, as defined by the proximal wall 120, and an opened distal end. The central bore 112 has a dampening medium 129 (FIG. 2) stored therein between the annular inner wall 128, the proximal wall 120, and the piston 106. The medium 129 may be a liquid (e.g., oil, water, wellbore fluid), gel, or air or other compressible or incompressible gas. The central bore 112 may be devoid of fluid prior to deployment of the setting tool 100 into the wellbore such that upon deployment, wellbore fluid may automatically fill the central bore 112 via the port 130 to equalize the hydrostatic pressure between the wellbore and the central bore 112. In certain aspects or embodiments, the central bore 112 may contain a dampening medium 129 inside the central bore 112 before the setting tool 100 is deployed downhole. The annular inner wall 128 of the outer housing 102 may define a ventilation port or ports 130 radially therethrough that allows for the medium 129 stored in the central bore 112 to exit into the wellbore upon a threshold pressure being achieved within the central bore 112. In aspects, the ventilation port 130 may have a plug or valve that opens/unplugs at a certain pre-defined pressure from the central bore 112. In the case where the central bore 112 is filled with wellbore fluid from the wellbore, the port 130 may have a mesh or filter (as described in further detail with reference to FIG. 9) to prevent solid parts, debris, dirt, or grime of the wellbore fluid from moving into the central bore 112. Further, the mesh may prevent the port 130 from being blocked. The number and position of the vent port or ports 130 is not limited or fixed except to the extent consistent with this disclosure. For example, the vent port 130 is positioned proximal to the piston assembly within the central bore 112, to ensure that the dampening medium 129 is acting against and venting due to proximal movement of the piston assembly 110.

The piston 106 is received in the opened distal end of the central bore 112 to enclose the medium 129 in the central bore 112. When the piston 106 is in an initial position (e.g., before the power charge 118 is activated), the piston 106 may be disposed in proximity to the distal end portion 102*b* of the outer housing 102. In aspects, the piston 106 may be axially fixed relative to the outer housing 102 by a shear pin or pins (not explicitly shown). In other aspects, the dampening medium 129 in the central bore 112 maintain the piston 106 in the initial position. The piston 106 may be engaged to and form a fluid-tight seal with the annular inner wall 128 of the outer housing 112 while being permitted to slide axially through the central bore 112 to compress or move the medium 129 stored within the central bore 112. The piston 106 is located between the central bore 112 and the expansion chamber 126 and fluidly isolates the central bore 112 and the expansion chamber 126 from one another, such that mixing between the combustion gas within the expansion chamber 126 and the medium 129 within the central bore 112 is prevented. As such, as the gas from the combusting power charge 118 moves distally through the gas channels 124 and into the expansion chamber 126, pressure in the expansion chamber 126 increases and pressure from the gas drives the piston 106 proximally through the central bore 112. The piston 106 has at least one piston seal 106*a* (e.g., an O-ring), and in some aspects, two axially separated piston seals 106*a*. In an aspect, the outer housing 102, piston 106, and piston seals 106*a* (and/or other components of the setting tool 100) may be configured—e.g., dimensioned—such that the piston seals 106*a* will pass the ventilation port 130 during the piston 106 moving proximally through the central bore 112. After the seals 106*a* of the piston 106 move proximally past the ventilation port 130, the ventilation port 130 is in fluid communication with the expansion chamber 126, i.e., the area of high pressure on the distal side of the piston 106, and the high-pressure gas from the expansion chamber 126 may vent through the ventilation port 130.

Figure 3A:
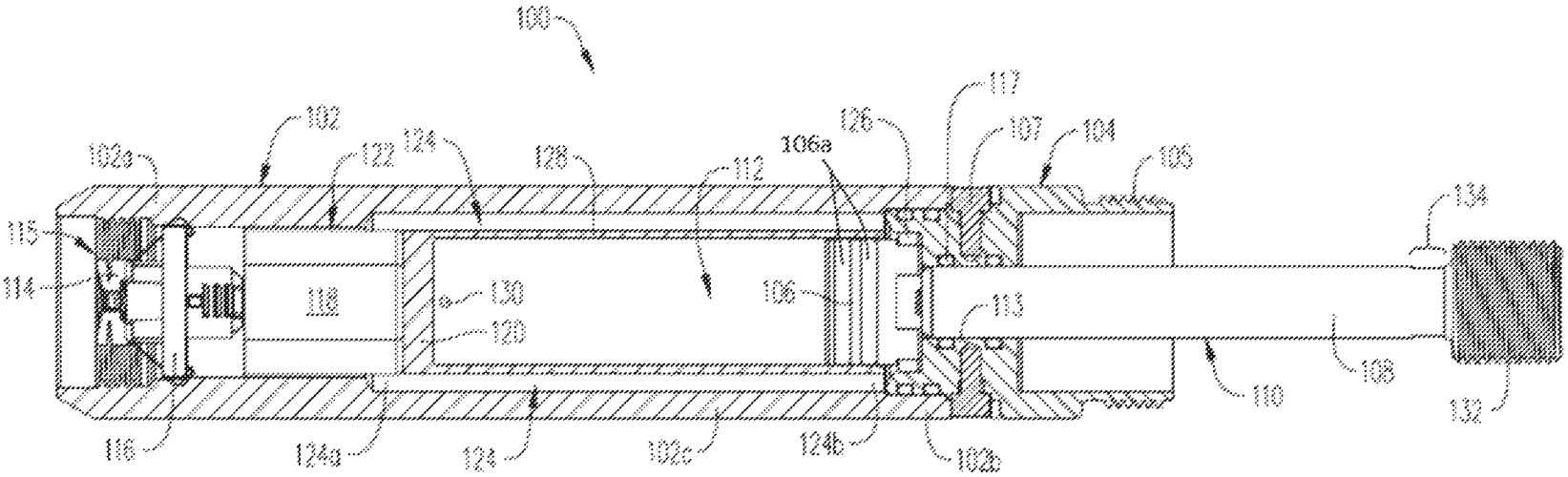
FIG. 3A is a side, cutaway view of the setting tool of FIG. 2.
Figure 3B:
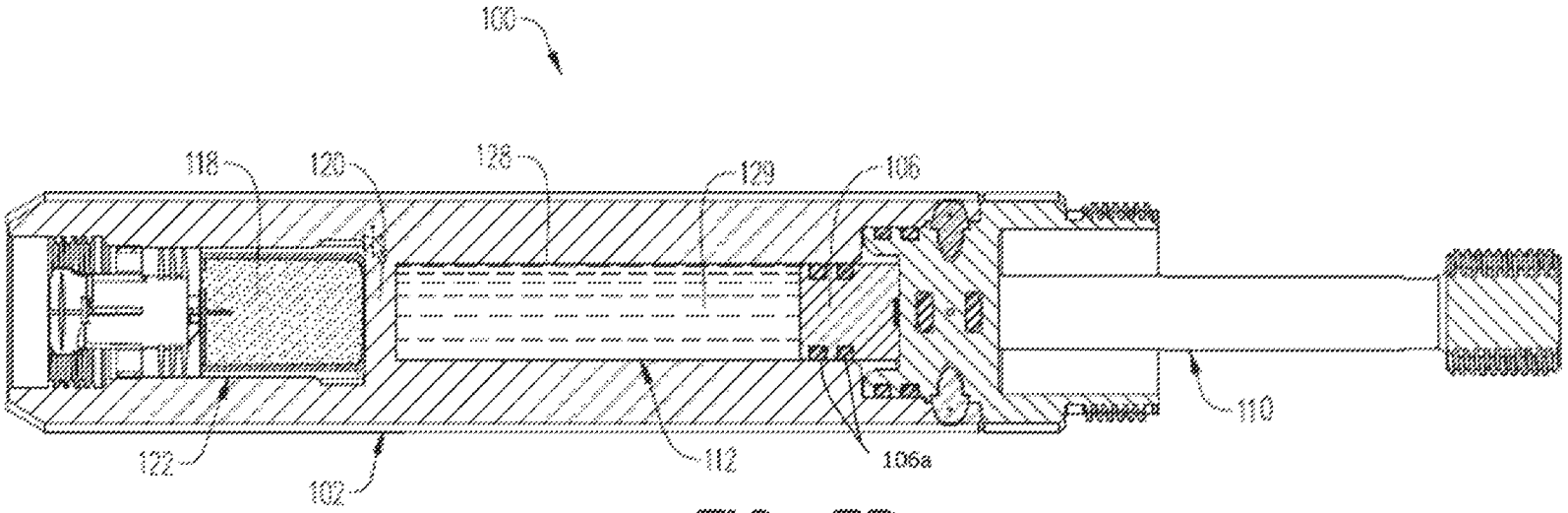
FIG. 3B is another side, cutaway view of the setting tool of FIG. 2.
Figure 4A:
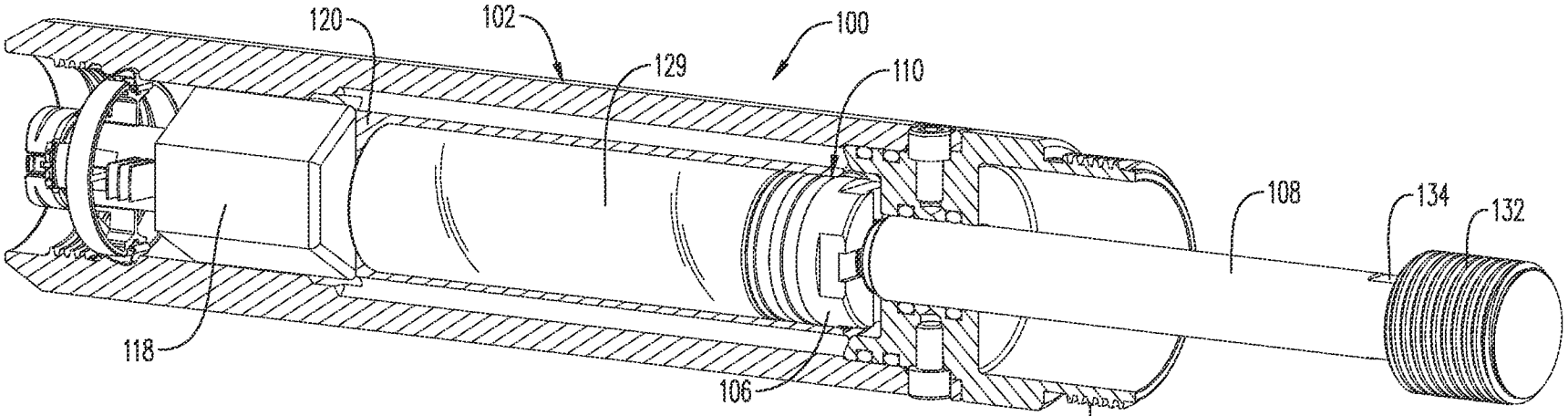
FIG. 4A is a perspective, cutaway view of the setting tool of FIG. 1 with a piston assembly thereof shown in an unactuated position.
Figure 4B:
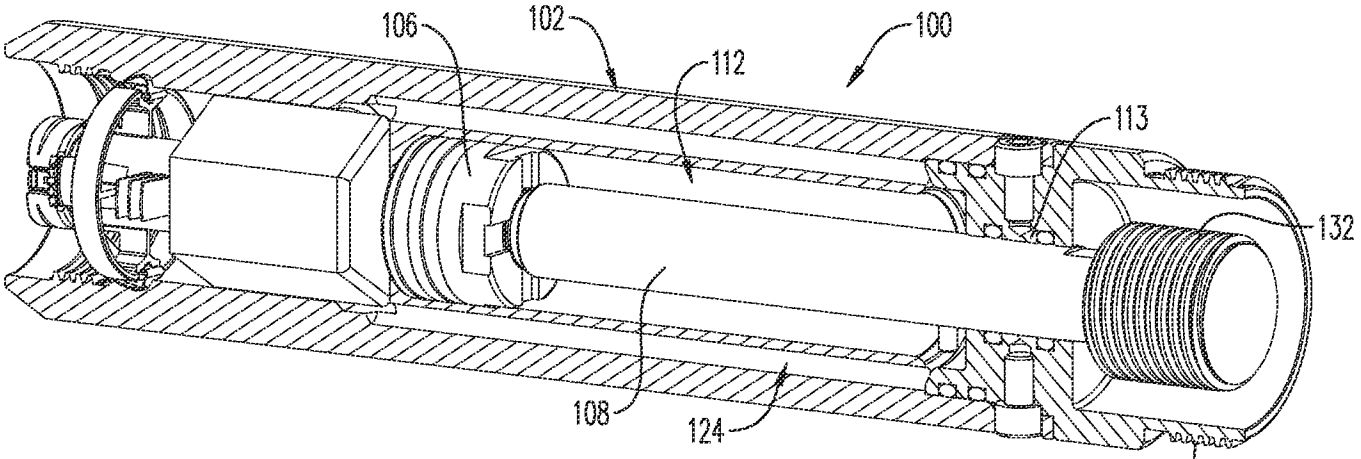
FIG. 4B is a perspective, cutaway view of the setting tool of FIG. 1 with the piston assembly thereof shown in an actuated position.

With reference to FIG. 3A, the piston rod 108 of the piston assembly 110 has a proximal end portion threadedly coupled to the piston 106 such that the piston 106 and the piston rod 108 axially move with one another as a unit. In aspects, the piston 106 and the piston rod 108 may be integrally formed with one another or otherwise coupled to one another using any suitable fastening engagement. The proximal end portion of the piston rod 108 is sealingly engaged with a neck portion 113 of the piston sub 104 to prevent gas from flowing from the expansion chamber 126 to an environment external to the piston sub 104. The piston rod 108 has a distal end portion having an enlarged diameter and having a threaded external surface 132 configured to threadedly couple to a plug 603 (FIG. 5), such as, for example, a distal end portion 607 of the plug 603. The piston rod 108 has a neck portion 134 having a reduced diameter relative to the remainder of the piston rod 108 that allows for egress of combustion gas from the expansion chamber 126 when the piston 106 is in a proximal-most position (for example, as shown in FIG. 4B), in which the neck portion 134 of the piston rod 108 is received in the neck portion 113 of the piston sub 104. For example, as the piston 106 moves longitudinally in the central bore 112 into proximity with the proximal wall 120, combustion gas may exit the expansion chamber 126 (e.g., which may slow movement of the piston 106).

Figure 12:
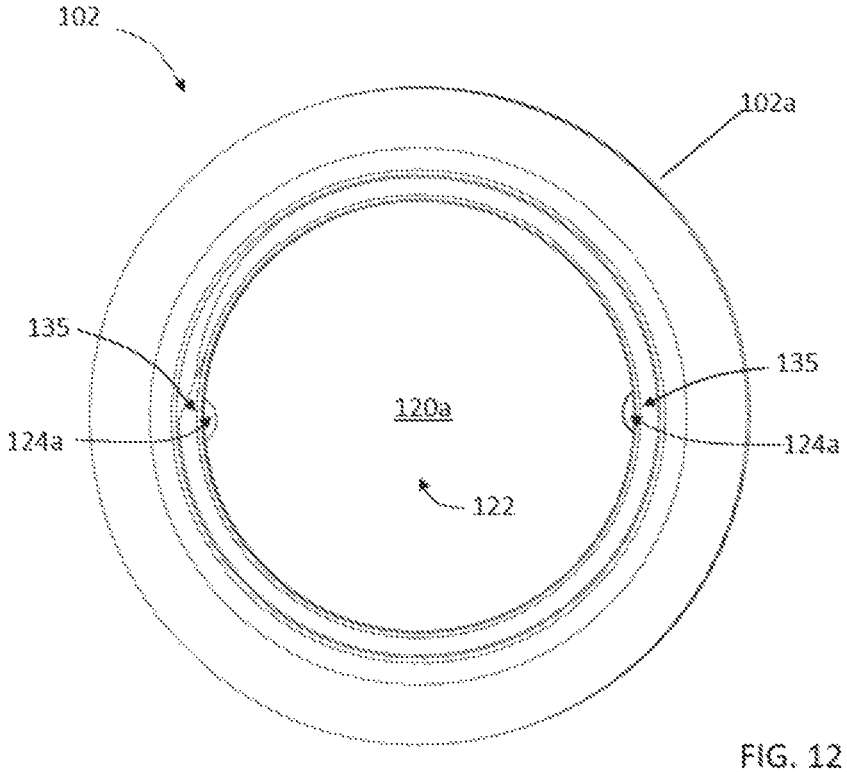
FIG. 12 is a proximal end view of the outer housing of FIG. 10.
Figure 13:
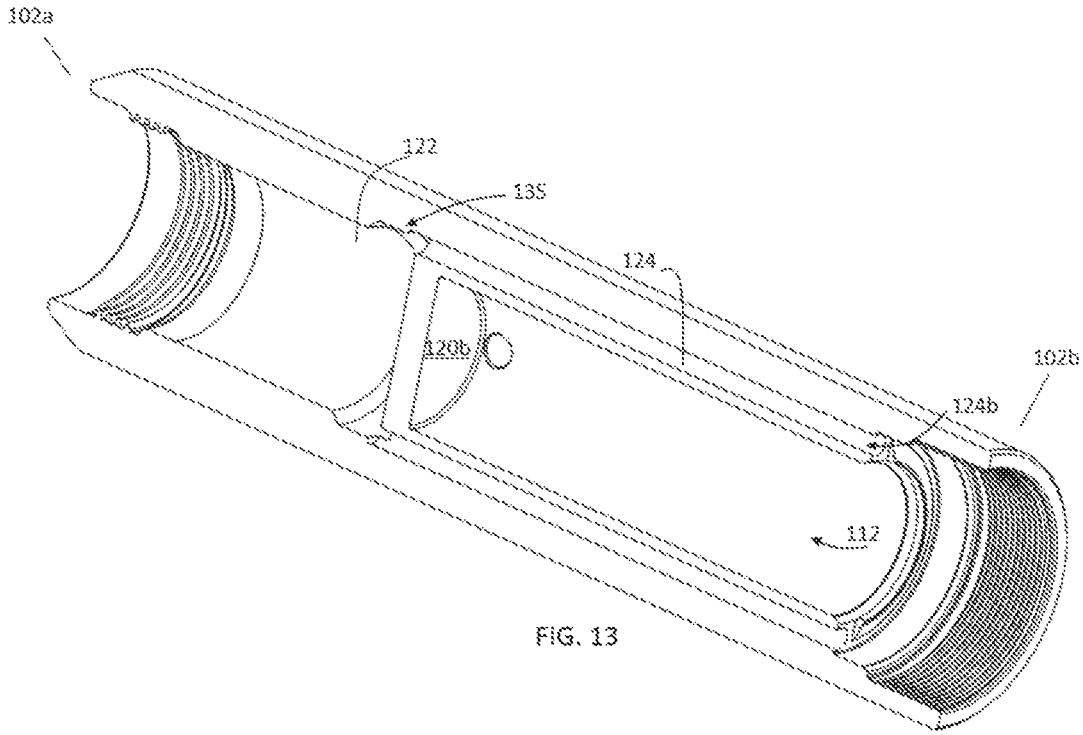
FIG. 13 is another perspective cutaway view of the outer housing of FIG. 10.

With reference in particular to FIGS. 10-14, the outer housing 102 according to the exemplary embodiments is shown in isolation. As shown further in FIGS. 10-14, the proximal wall 120 includes a proximal surface 120*a* facing the power charge chamber 122 and a distal surface 120*b* facing the central bore 112. A chamfer section 135 is positioned between the gas channel 124 and the power charge chamber 122. In an aspect, an inner surface 138 of the outer housing 102 that extends along and in part defines a respective gas channel 124 tapers and defines at least a first shoulder 136 and in the exemplary embodiment a second shoulder 137 of the chamfer section 135, before continuing to extend through the power charge chamber 122. Accordingly, as shown in FIG. 12, viewing the outer housing 102 from the proximal end 102*a*, the proximal surface 120*a* of the proximal wall 120 is visible through the power charge chamber 122 and a portion of each gas channel 124 is visible extending inwardly slight further than the second shoulder 137 of the chamfer section 135.

Figure 14:
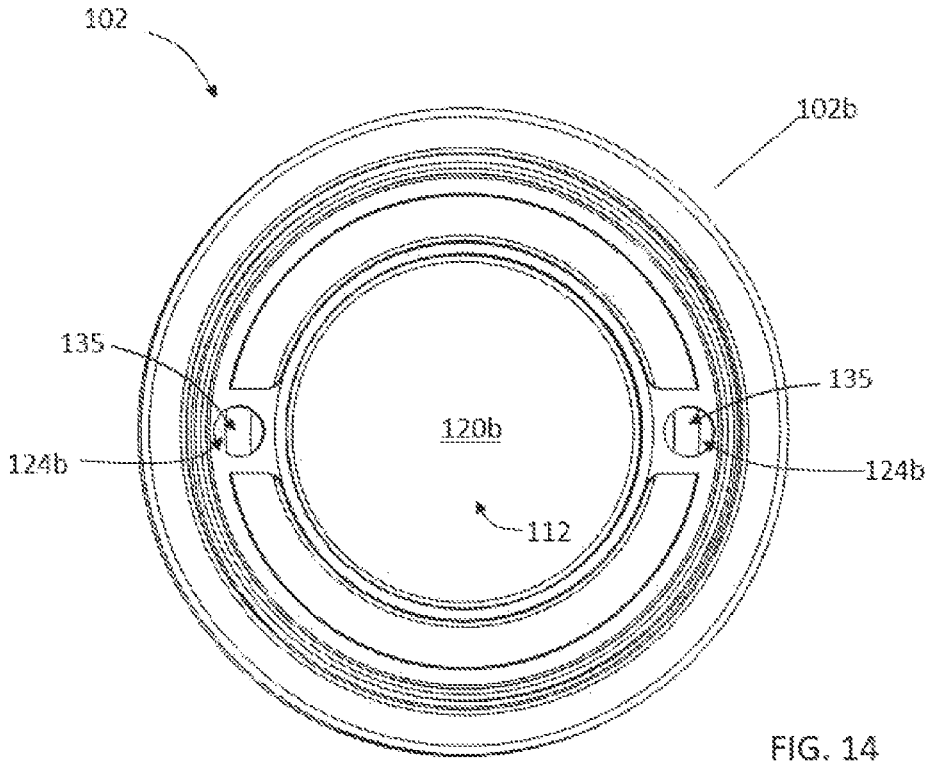
FIG. 14 is a distal end view of the outer housing of FIG. 10.

Similarly, as shown in FIG. 14, viewing the outer housing 102 from the distal end 102*b*, the distal surface 120*b* of the proximal wall 120 is visible through the central bore 112 and the opening of each gas channel 124 is visible and the chamfer section 135 positioned at the proximal end 124*a* of the gas channel 124 is visible through the gas channel 124.

Figure 5:
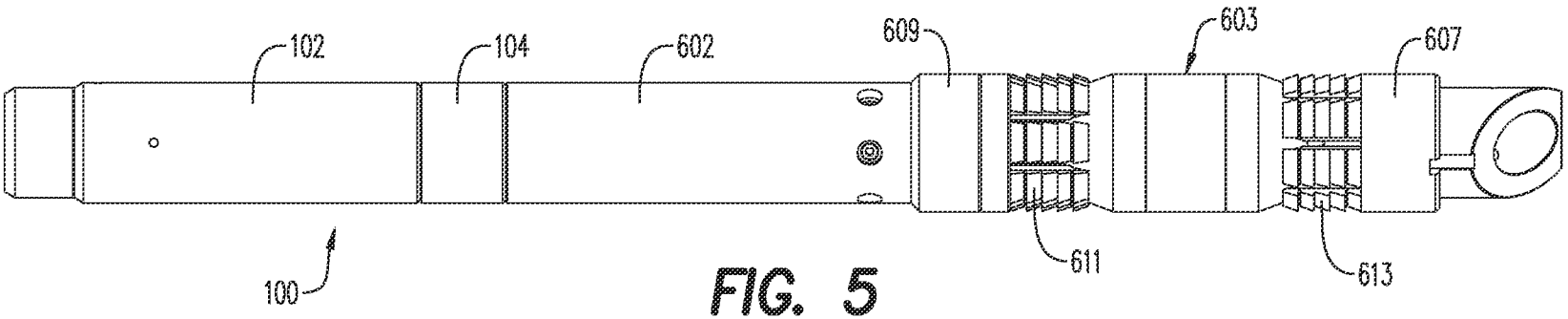
FIG. 5 is a side view illustrating the setting tool of FIG. 1 coupled to a setting sleeve and a frac plug according to an exemplary embodiment.

The piston sub 104 may be removably or fixedly secured with the distal end portion 102*b* of the outer housing 102 using a fastener 107, such as, for example, a screw or bolt. In aspects, the piston sub 104 may be integrally formed with the distal end portion 102*b* of the outer housing 102. In other aspects, as described in further detail below with reference to FIGS. 7 and 8, the piston sub 104 may be threadedly coupled to the outer housing 102. The piston sub 104 may have a threaded outer surface 105 for threadedly connecting to a setting sleeve 602 (FIG. 5). The neck portion 113 of the piston sub 104 may have an inner diameter substantially equal to the outer diameter of the piston rod 108. The neck portion 113 may have a seal 117 (e.g., an O-ring seal) positioned in an inner surface thereof to fluidly isolate the gas channels 124 and the expansion chamber 126 of the outer housing 102 from the environment external to the piston sub 104. The environment external to the piston sub 104 may include an internal chamber of the setting sleeve 602 (FIG. 5) when the setting sleeve 602 is coupled to the piston sub 104.

In operation, the igniter 114 of the ignition assembly 115 ignites the power charge 118, which generates gas that moves from the power charge chamber 122 of the outer housing 102 distally through the gas channels 124. The gas moves from the gas channels 124 into the expansion chamber 126, whereby the gas contacts the piston 106 (e.g., on a distal surface/face of the piston 106) and drives the piston assembly 110 (including the piston 106 and the piston rod 108) proximally through the central bore 112 of the outer housing 102 against the resistance of the dampening medium 129. As such, the piston assembly 110 moves proximally from an unactuated or distal position (FIG. 4A) to an actuated or proximal position (FIG. 4B). Since the distal end portion 132 of the piston rod 108 is axially fixed to a portion of the plug 603 (e.g., the distal end portion 607), the distal end portion 607 of the plug 603 is moved proximally toward a proximal end portion 609 of the plug 603 as the piston rod 108 moves from the distal position to the proximal position. As such, expansion members 611, 613 of the plug 603 are compressed axially and expanded radially to fix the plug 603 in the wellbore.

As the piston 106 moves proximally, the volume of the central bore 112 is reduced, whereby the medium 129 therein is compressed. As the medium 129 (e.g., a liquid) has a much lower compressibility than gas, the medium 129 in the central bore 112 is forced out of the central bore 112 through the ventilation port 130 at a controlled rate. The movement of the piston 106 is dampened by the resistance provided by the medium 129 and the rate of fluid movement out of the tool 100. For example, the amount of dampening/resistance to the movement of the piston 106 may be adjusted by the diameter and/or shape of the ventilation port 130, the total number of ventilation ports 130, and/or the compressibility and the viscosity of the medium 129 within the central bore 112.

In the actuated or proximal position of the piston 106, the neck portion 134 of the piston rod 108 may be concentrically disposed within the neck portion 113 of the piston sub 104 (FIG. 4B) to fluidly connect the expansion chamber 126 with the environment external of the piston sub 104 (e.g., the inner chamber of the setting sleeve 602). As such, the gas from the expansion chamber 126 exits the expansion chamber 126 via a gap formed between the neck portion 134 of the piston rod 108 and the neck portion 113 of the piston sub 104.

Figure 6:
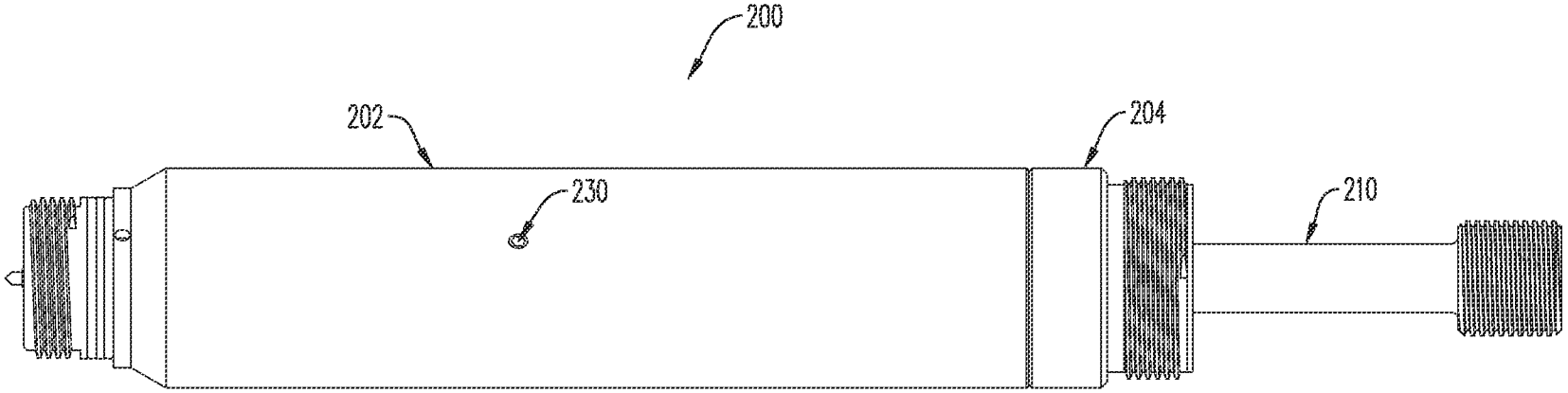
FIG. 6 is a side view illustrating another embodiment of a setting tool for actuating a tool in a wellbore.
Figure 7:
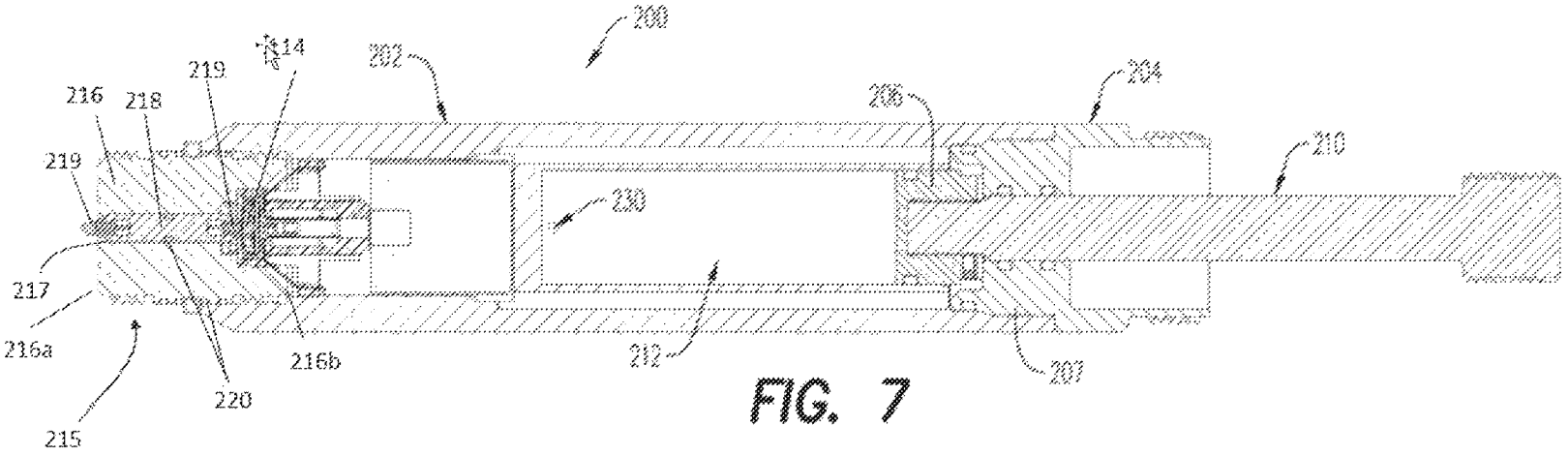
FIG. 7 is a longitudinal cross-sectional view of the setting tool of FIG. 6.
Figure 8:
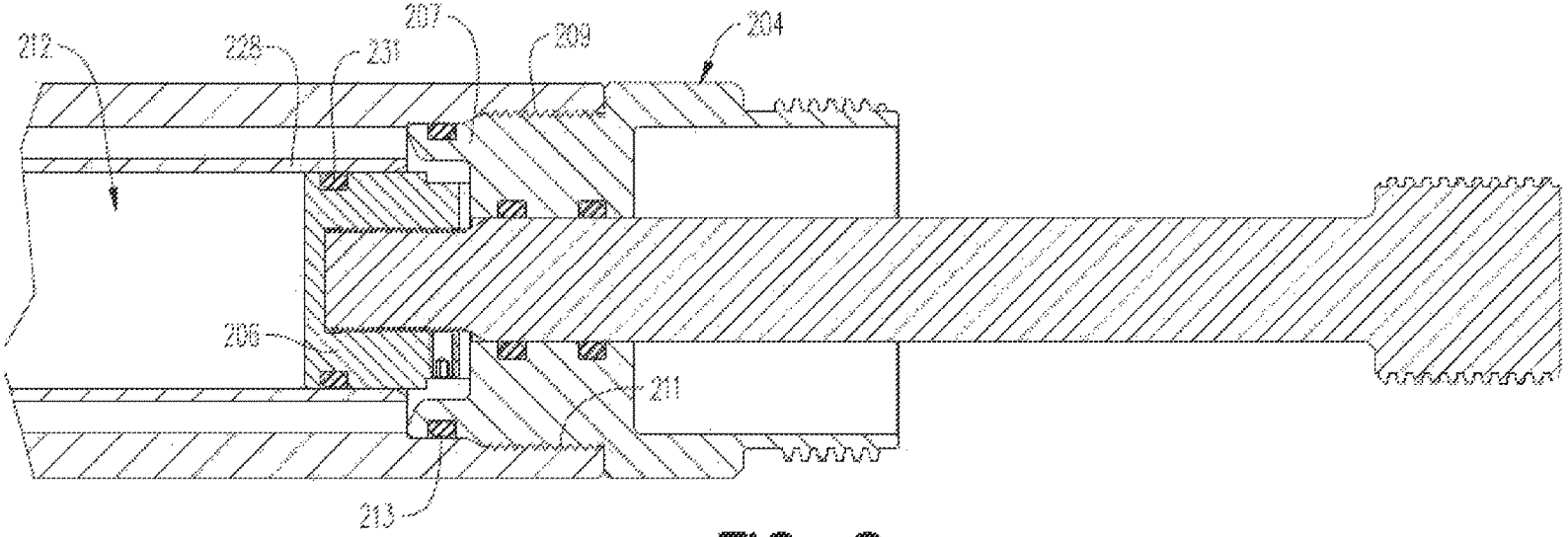
FIG. 8 is an enlarged view of a portion of the setting tool shown in FIG. 7.

With reference to FIGS. 6-8, another exemplary embodiment of a setting tool 200 is provided for setting frac or bridge plugs in a tubular member of a wellbore. The setting tool 200 is substantially similar to the setting tool 100 of FIGS. 1-5. Therefore, only selected features of the setting tool 200 will be described in detail herein. The setting tool 200 generally includes a setting tool outer body or outer housing 202, a piston sub 204 coupled to a distal end portion of the outer housing 202, and a piston assembly 210 positioned within a longitudinally-extending central bore 212 defined through the outer housing 202. In aspects, the setting tool 200 may be a single use, disposable setting tool 200.

The central bore 212 has a dampening medium stored therein. The medium may be a liquid (e.g., oil, water, wellbore fluid), gel, or air or other compressible or incompressible gas. The central bore 212 may be devoid of fluid prior to deployment of the setting tool 200 into the wellbore such that upon deployment, wellbore fluid may automatically fill the central bore 212 via a ventilation port 230 to equalize the hydrostatic pressure between the wellbore and the central bore 212. The port 230 extends radially through the outer housing 202 to allow for the medium stored in the central bore 212 to exit into the wellbore upon a threshold pressure being achieved within the central bore 212.

Also shown in FIG. 7 is a tandem seal adapter 215 according to an exemplary embodiment, the tandem seal adapter 215 serving as a connector between the setting tool 200 and a wellbore tool (not shown) above the setting tool 200 on the tool string. The tandem seal adapter 215 according to the exemplary embodiment includes a body portion 216 having a bore 217 passing from a proximal end 216*a* of the body portion 216 to a distal end 216*b* of the body portion 216. The distal end 216*b* of the body portion 216 is configured, e.g., dimensioned, for threading into the setting tool 200 adjacent the igniter 114 and the proximal end 216*a* of the body portion 216 is configured for connecting to the wellbore tool above the setting tool 200. The bore 217 is configured for housing a pressure bulkhead 218 within the bore 217. The pressure bulkhead 218 includes electrical connectors 219 and the pressure bulkhead 218, electrical connectors 219, and tandem seal adapter body 216 are together configured for making electrical contact with and communicating an electrical signal, such as an ignition signal, between an electrical connector (not shown) adjacent the proximal end 216*a* of the body portion 216 and an electrical connector (not shown) of the igniter 114, when the tandem seal adapter 216 is connected between the setting tool 200 and the wellbore tool above. Each of the tandem seal adapter body portion 216 and pressure bulkhead 218 may have external o-rings 220 for creating a pressure and fluid seal between adjacent wellbore tools and between an exterior and an interior of the wellbore tools.

Figure 9:
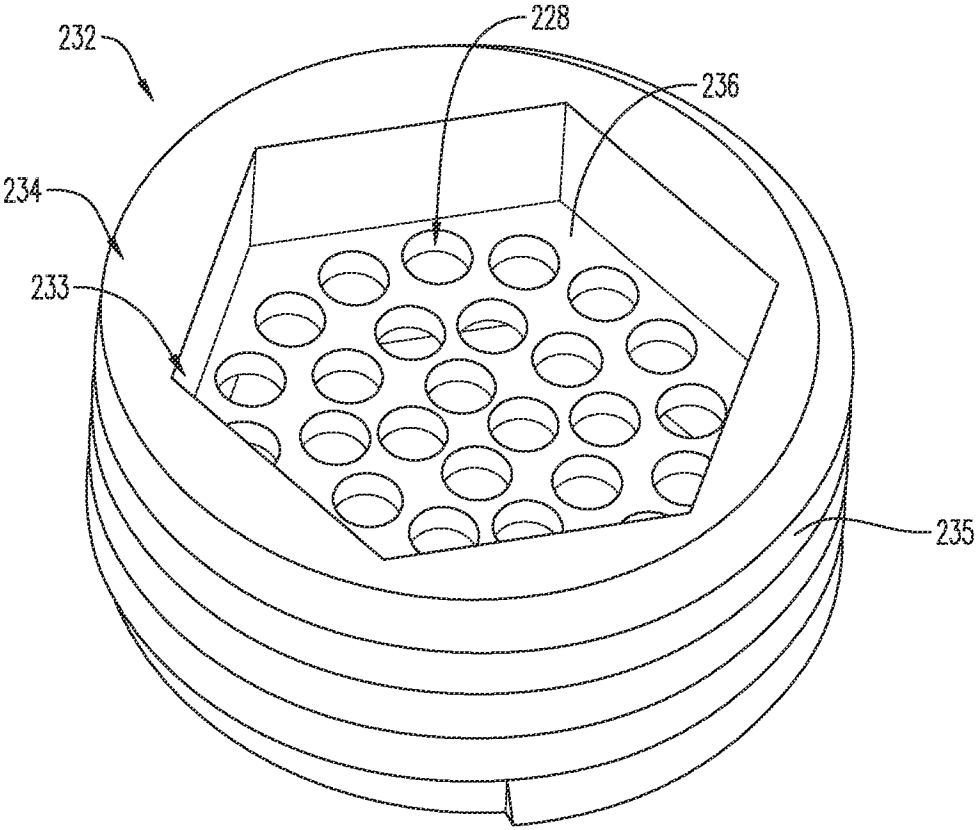
FIG. 9 is a perspective view illustrating a filter for use with the setting tool of FIG. 6.
Figure 10:
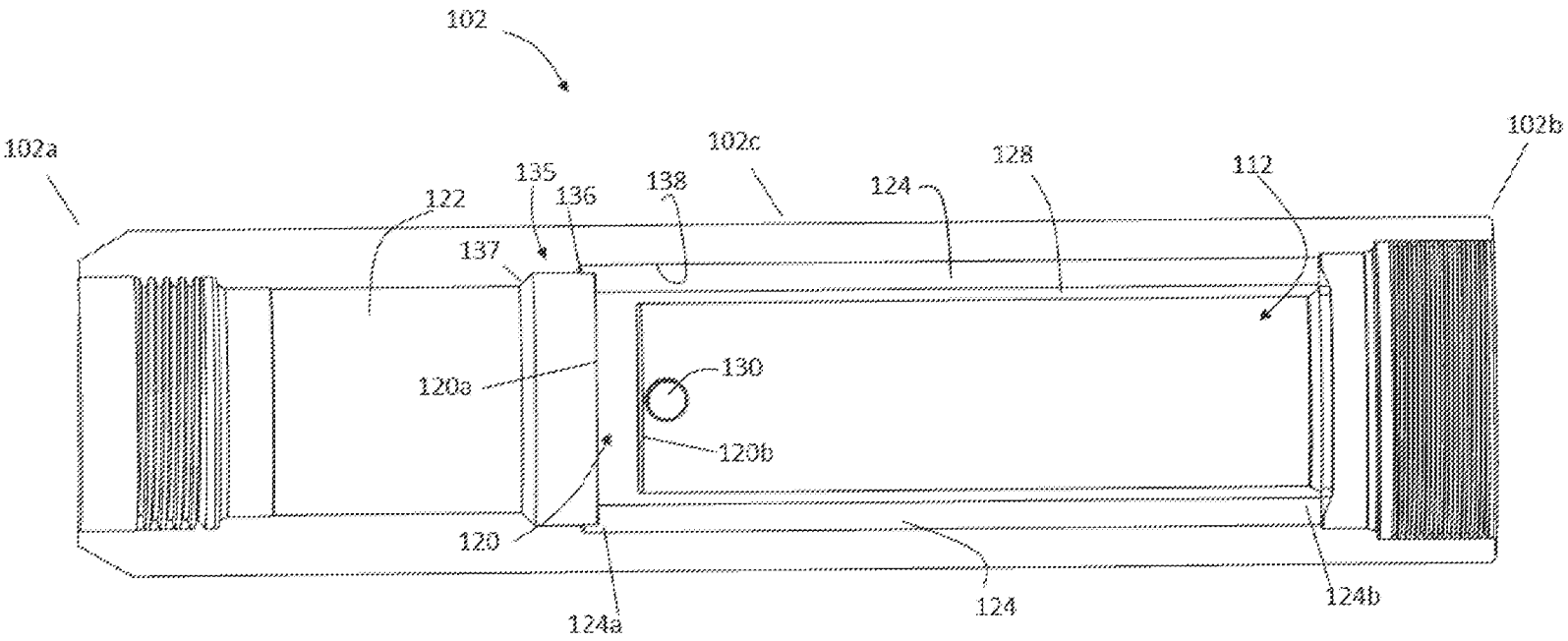
FIG. 10 is a cross-sectional view of an outer housing according to an exemplary embodiment.
Figure 11:
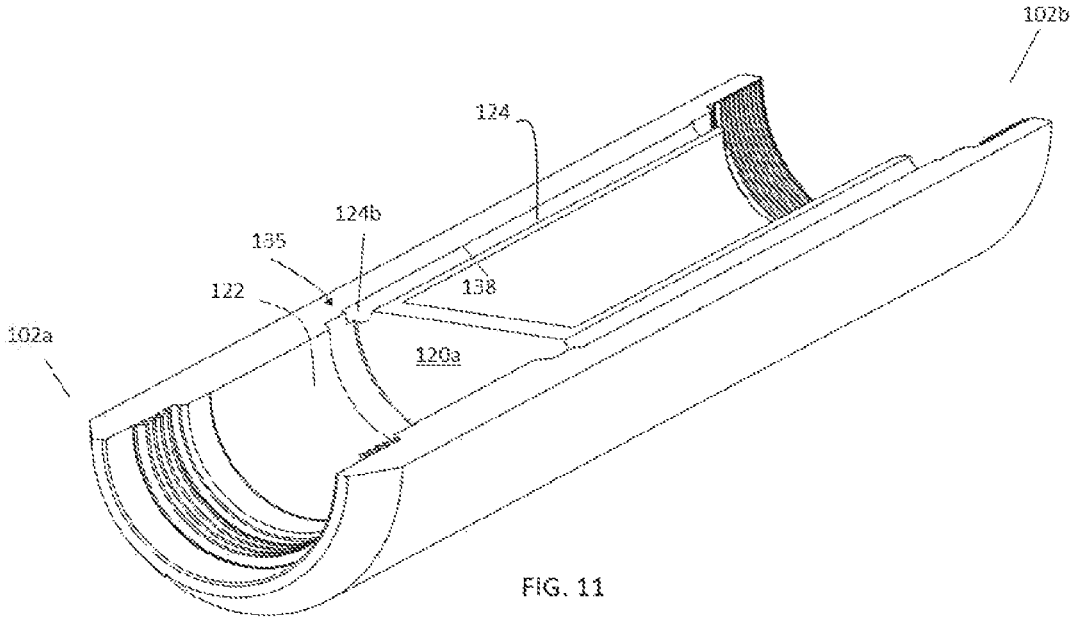
FIG. 11 is a perspective cutaway view of the outer housing of FIG. 10.

In aspects, as shown in FIG. 9, the ventilation port 230 may have a mesh or filter 232 positioned therein to prevent solid parts, debris, dirt, or grime of the wellbore fluid from moving into the central bore 112. The filter 232 may have an annular main body 234 defining a channel 233 therethrough, and a plate 236 positioned within the channel 233 of the annular main body 234. The annular main body 234 may have an external thread 235 for threadedly coupling the filter 232 to the port 230. The plate 236 defines a plurality of perforations or holes 238 therethrough that are sized to prevent unwanted debris or the like from passing into the central bore 212 while allowing for the medium to exit the port 230. In aspects, the plate 236 may be fabricated from a rigid material, such as, for example, metal. In other aspects, the plate 236 may be a flexible mesh. In still further embodiments and aspects, the mesh or filter 232 may be formed from plastic and/or may be a plastic cap (not shown) that does not provide fluid communication therethrough. In an aspect, the plastic cap may be retained in the ventilation port until the piston assembly 210 moves proximally through the central bore 212 and compresses the dampening medium to a pressure at which the plastic cap is expelled from the vent port 230 and the dampening medium escapes the central bore 212 through the vent port 230.

The piston sub 204 may be threadedly secured within the distal end portion of the outer housing 202. More specifically, the piston sub 204 has a proximal end portion 207 having a threaded outer surface 209 for threadedly connecting to a threaded inner surface 211 of the outer housing 202. The proximal end portion 207 of the piston sub 204 may have a seal 213 (e.g., an O-ring seal) positioned thereabout for forming a fluid-tight seal with the outer housing 202. The piston assembly 210 has a piston 206 that forms a fluid-tight seal with an inner wall 228 of the outer housing 202. The piston 206 has a single seal 231 (e.g., an O-ring seal), but in some aspects, the piston 206 may have two or more seals.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one," "one or more" and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment," "some embodiments," "an embodiment," and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic, or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur - this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine," "calculate," and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A disposable setting tool for actuating a tool in a wellbore, comprising:

an outer housing having a proximal end portion defining a power charge chamber, and a distal end portion, the outer housing defining a longitudinally-extending bore configured for holding a medium therein, the bore and the power charge chamber being divided from one another by a proximal wall; and a piston configured for receipt in the bore and to move axially relative to the outer housing, wherein the outer housing defines a ventilation hole radially therethrough for permitting a flow of the medium out of the bore in response to axial movement of the piston.

2. The disposable setting tool according to claim 1, wherein the outer housing defines a gas channel extending axially between the power charge chamber and the piston.

3. The disposable setting tool according to claim 2, wherein the piston fluidly isolates the gas channel from the bore.

4. The disposable setting tool according to claim 2, wherein the piston is located between the bore and the gas channel.

5. The disposable setting tool according to claim 2, further comprising a power charge received in the power charge chamber, wherein the power charge chamber is in fluid communication with the gas channel such that upon a combustion of the power charge, gas from the combustion travels through the gas channel and drives the piston proximally through the bore.

6. The disposable setting tool according to claim 2, wherein the gas channel extends longitudinally along a length of the outer housing.

7. The disposable setting tool according to claim 1, wherein the medium is a liquid, wellbore fluid, gel, or gas.

8. The disposable setting tool according to claim 1, further comprising a piston rod extending distally from the piston and distally beyond the distal end portion of the outer housing.

9. The disposable setting tool according to claim 8, wherein the piston rod has a distal end portion configured to couple to a plug.

10. The disposable setting tool according to claim 9, wherein the piston rod has a main body portion and a neck portion having a reduced diameter relative to the main body portion.

11. The disposable setting tool according to claim 9, wherein the distal end portion of the piston rod has a threaded outer surface configured to threadedly couple to the plug.

12. A tool for setting a plug in a wellbore, comprising:

an outer housing including:

a proximal end portion defining a power charge chamber;

a distal end portion configured for coupling to a setting sleeve; and an intermediate portion extending between the proximal end portion and the distal end portion, the intermediate portion having an annular inner surface defining a longitudinally-extending central bore configured for holding a dampening medium therein;

a power charge received in the power charge chamber; and a piston received in the central bore and configured to translate relative to the annular inner surface, wherein the outer housing defines a longitudinally-extending gas channel in fluid communication with the power charge chamber and the piston such that the piston is configured to move proximally within the central bore in response to a combustion of the power charge, wherein the outer housing defines a ventilation hole radially therethrough for permitting a flow of the dampening medium out of the central bore during proximal movement of the piston through the central bore.

13. The tool according to claim 12, wherein the piston in an unactuated position within the central bore fluidly isolates the gas channel from the ventilation hole and the piston in an actuated position within the central bore does not fluidly isolate the gas channel from the ventilation hole.

14. The tool according to claim 12, wherein the gas channel extends longitudinally along a length of the outer housing, the gas channel having a proximal end portion positioned adjacent the power charge chamber, and a distal end portion positioned adjacent the piston.

15. The tool according to claim 14, wherein the outer housing includes a proximal wall extending perpendicularly relative to a longitudinal axis defined by the outer housing, the proximal wall being positioned axially between and separating the power charge chamber and the central bore.

16. A tool for setting a plug in a wellbore, comprising:

an outer housing including a proximal end portion defining a power charge chamber, and a distal end portion configured for coupling to a setting sleeve;

a power charge positioned in the power charge chamber;

a dampening medium stored in the outer housing and positioned distally of the power charge; and a piston received in the outer housing and hydraulically coupled to the dampening medium, wherein the outer housing defines a longitudinally-extending gas channel having a proximal end portion in fluid communication with the power charge chamber, and a distal end portion positioned adjacent the piston, such that the piston is configured to move proximally within the outer housing in response to a combustion of the power charge, wherein the outer housing defines a ventilation hole radially therethrough for permitting a flow of the dampening medium out of the central bore during proximal movement of the piston through the outer housing.

17. The tool according to claim 16, further comprising a filter positioned within the ventilation hole, wherein the filter includes a perforated plate or a mesh configured to prevent debris from passing through the ventilation hole.

* * * * *